US007493859B2

(12) United States Patent
Russell

(10) Patent No.: US 7,493,859 B2
(45) Date of Patent: Feb. 24, 2009

(54) SYSTEM AND METHOD FOR ZERO LATENCY DISTRIBUTED PROCESSING OF TIMED PYROTECHNIC EVENTS

(75) Inventor: David Wayne Russell, P.O. Box 8274, Incline Village, NV (US) 89452

(73) Assignee: David Wayne Russell, Grass Valley, CA (US)

( * ) Notice: Subject to any disclaimer, the term of this patent is extended or adjusted under 35 U.S.C. 154(b) by 474 days.

(21) Appl. No.: 11/212,829

(22) Filed: Aug. 25, 2005

(65) Prior Publication Data

US 2006/0042495 A1 Mar. 2, 2006

Related U.S. Application Data

(60) Provisional application No. 60/605,422, filed on Aug. 30, 2004.

(51) Int. Cl.
*F42B 4/04* (2006.01)

(52) U.S. Cl. ..... 102/361; 102/217; 102/215; 102/200; 102/360; 102/477

(58) Field of Classification Search ..... 102/276, 102/215, 217, 311, 312, 360, 477, 335, 361, 102/200, 202.5, 206
See application file for complete search history.

(56) References Cited

U.S. PATENT DOCUMENTS 5,214,236 A * 5/1993 Murphy et al. ..... 102/217
5,539,636 A * 7/1996 Marsh et al. ..... 702/79
6,173,651 B1 * 1/2001 Pathe et al. ..... 102/218
6,490,977 B1 * 12/2002 Bossarte et al. ..... 102/342

FOREIGN PATENT DOCUMENTS

DE 19731655 A1 * 1/1998

OTHER PUBLICATIONS

Translation of DE 19731655 A1, Aust et al., Germany, Jan. 1998.*

* cited by examiner

*Primary Examiner*—James S Bergin
(74) *Attorney, Agent, or Firm*—Ian F. Burns & Associates, P.C.

(57) ABSTRACT

A method for achieving zero, or near zero, latency timed pyrotechnic events by utilizing distributed processing is presented. A list of timed events may be used to synchronize a pyrotechnic firing sequence with music or other external events. This list is distributed over a series of embedded microprocessors. Each microprocessor is then synchronized to a master controller clock, and enabled such that each processor may then fire independently as required by the master list. This distributed process removes the split-second timing requirement from the main controller enabling the achievement of zero latency and providing significantly more timing events to be processed simultaneously while alleviating problems such as wireless radio interference delays. Each module is capable of forwarding information to other modules, which may be a position that prevents wireless communication directly with the master controller.

8 Claims, 6 Drawing Sheets

DISTRIBUTED PYROTECHNIC FIRING SYSTEM

FIGURE 1 DISTRIBUTED PYROTECHNIC FIRING SYSTEM

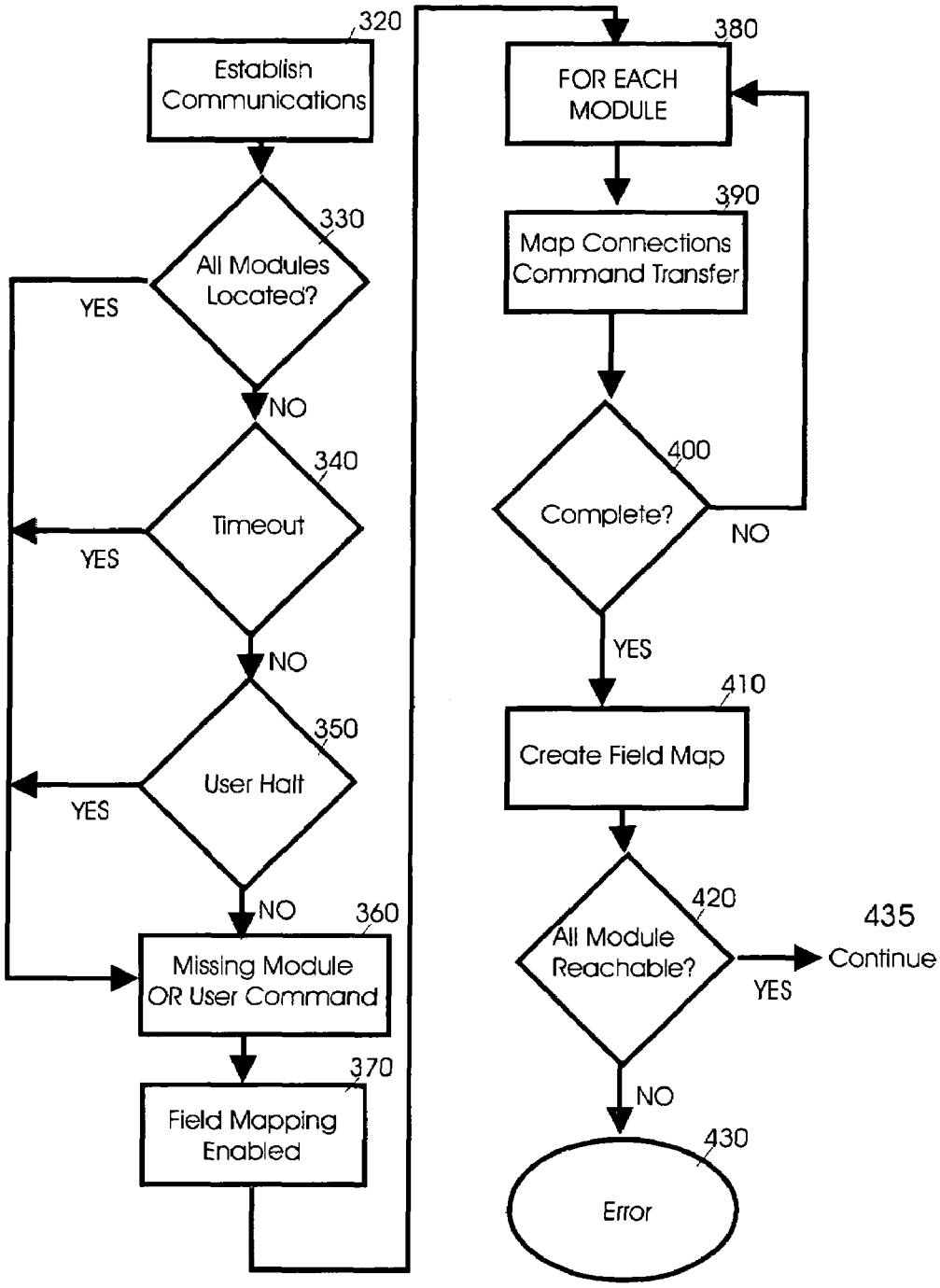
FIGURE 3 ENABLING FIELD MAPPING

Intermediate Map of One Module

| Other Module: | 2 | 3 | 4 | 5 | 6 |
|---|---|---|---|---|---|
| Module 001: | X | X | | | X |

Full Field Map

| Module: | 1 | 2 | 3 | 4 | 5 | 6 |
|---|---|---|---|---|---|---|
| 1 | X | X | X | | | X |
| 2 | X | X | | X | | |
| 3 | X | | X | | | X |
| 4 | | X | | X | | |
| 5 | | | | | X | X |
| 6 | X | | X | | X | X |

440

List of Modules Reachable by Command Module

CM: 1 2 3

450

Shadowed Module 4
List of Shadowed Module

4: 2

List Match: 2==2

Routing to 4 can be accomplished
460— via Module 2 in one bridge,
470—via Modules 1 to 2 to 4 in two bridges, etc.

FIGURE 4 FIELD MAPPING ROUTING PATH

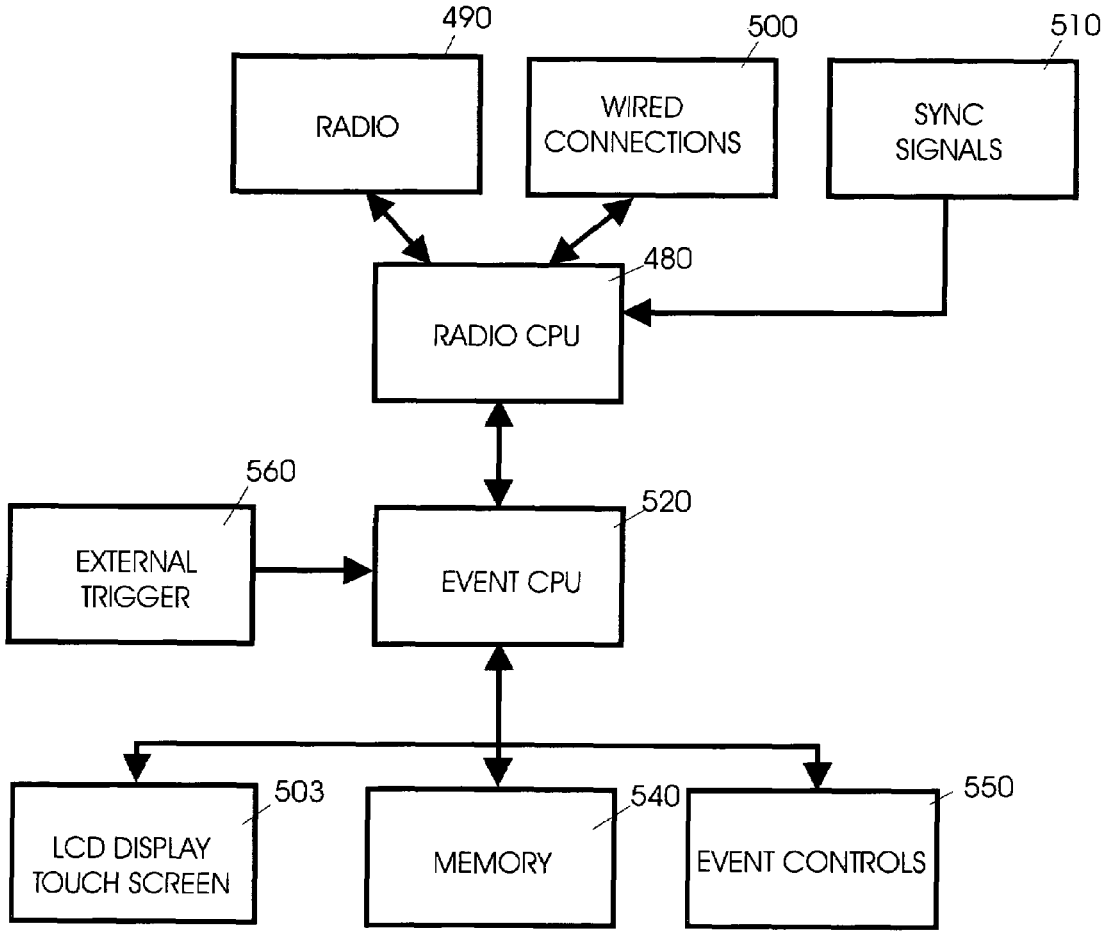
FIGURE 5 DUAL PROCESSOR ARCHITECTURE

SYSTEM AND METHOD FOR ZERO LATENCY DISTRIBUTED PROCESSING OF TIMED PYROTECHNIC EVENTS

CROSS-REFERENCE TO RELATED APPLICATIONS

The present Utility patent application claims priority benefit of the U.S. provisional application for patent 60/605,422 dated Aug. 30, 2004 "Method for distributed processing of pyrotechnic events" under 35 U.S.C. 119(e). The contents of this related provisional application are incorporated herein by reference.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

FIELD OF THE INVENTION

The present invention relates generally to pyrotechnic and explosive control systems in fireworks displays, special effects, and blasting industries.

BACKGROUND OF THE INVENTION

It can be appreciated that pyrotechnic controls have been in use for years. Typically, pyrotechnic controls are comprised of electrical firing systems that rely on switches or contact closure thrown by the operator or contact closures initiated by computer control, and systems which are either wired directly from the main controller to the pyrotechnic devices or connected via wireless link or wireless local area network from a main controller to a slave device which is, in turn, wired directly to the pyrotechnic devices.

A problem with existing pyrotechnic controls is that most pyrotechnic controllers operate in a master-slave architecture. Pyrotechnic devices are prepared with electric matches for ignition, and the electric match is wired through a series of field modules and cables to a master control switchboard. The exact nature of the wiring boxes, cables, and switchboard varies and is not significant. At a predetermined point of time, either the operator or a timing control device activates a switching circuit to allow current to flow through one or more electric matches or effectors.

Some current systems provide techniques for generating an event list that references an audio/video data structure. In such known techniques, once the event is associated, the audio stream structure provides the timing reference to initiate the event. Unfortunately, this only works in a master-slave environment or when all devices that must interpret events have access to the timing stream or signal. This same problem occurs when an explicit timing signal such as SMPTE timing track is used to initiate the events.

Two examples of current decentralized systems are next briefly described. The first example teaches an array of "intelligent" effectors linked by a 2- 3- or 4-wire communications bus, where the master controller does not have complete control over the effector's firing, but the effector may be equipped with sensors whose condition is checked before functioning is permitted to occur. The second example teaches an array of intelligent sensors with two interlinked processors, one for real-time processing and another for non-real time processing.

In known systems, activation control may be hardwired directly from the battery to the ignition device, or through a coded electrical signal. In either of these cases, the master firing panel initiates the communication burst or event that causes ignition. If more than one match or sets of matches (cues) must be fired simultaneously, there is often a delay as the master firing panel must initiate separate communication or electrical events. This results in delays and latency as each initiator is fired sequentially. In addition, if wireless communication is employed between the master controller and slave devices, which perform the switching function, radio interference can cause significant delays in each transmitted packet further delaying the timing of the operation. These delays seriously disrupt the critical synchronicity of the music and pyrotechnic effect reducing the enjoyment of the audience. In pyrotechnic displays, it is not unusual to try to simultaneously launch hundreds of devices at the same moment across a wide area facing the audience or "front". These delays seriously degrade this effect producing uneven firing patterns. In blasting operations, resonance effects require precise timing between initiator events, which would be critically destabilized by these delays and rendered ineffective. Similarly, in special effects work, the pyrotechnic event is often synchronized to sound or visual effects, and any delay in the firing would detract from the realism the operator is trying to achieve.

Another problem with conventional pyrotechnic controls is that existing controllers operate on a fixed voltage, current, and time specification. For example, a controller might apply to the electric match(es) when connected 12 volts at a maximum of 5 Amperes of current, for a period of 12.5 milliseconds. While this specification might be fine for most series wired electric matches, more time might be required if the matches are wired in parallel or inferior match production causes them to require more than 12.5 mS for ignition. In addition, if the operator wishes to control something other than a pyrotechnic device, a mechanical actuator for example, then a different voltage, current, and time pulse might be desired. Existing systems do not have the capability to automatically vary all of these parameters.

Yet another problem with the existing art is when wireless links are employed, a phenomenon known as shadowing occurs. When an object larger than the wavelength of the radio signal exists between the line-of-sight path of the transmitter and receiver, the signal may be seriously diminished or blocked completely. If the operator is holding the transmitter and changes position, different receivers may become shadowed, and other receivers may regain direct connections to the transmitter. Existing systems do not have the ability to maintain contact with a diverse array of receivers when the transmitter moves. Some current systems provide techniques for utilizing a local queue manager to deliver messages to diverse recipients; however, in the pyrotechnic field there is a need for the ability to instantly adapt to changing configurations.

While the foregoing devices may be suitable for the particular purpose to which they address, they are generally not as suitable for creating a firing system where zero latency, accurate timing, flexible output, and operator movement must be achieved.

In view of the foregoing disadvantages inherent in the known types of pyrotechnic controls now present in the prior art, there is a need for a new method for zero latency distributed processing of timed pyrotechnic events.

BRIEF DESCRIPTION OF THE DRAWINGS

The present invention is illustrated by way of example, and not by way of limitation, in the figures of the accompanying drawings and in which like reference numerals refer to similar elements and in which:

FIG. 3 is a flowchart illustrating an exemplary method of how the Command Module is enabled to perform the Field Mapping function, in accordance with an embodiment of the present invention;

FIG. 4 illustrates an exemplary Field Mapping Routing Path showing how the field map is utilized to determine the shortest routing path to a shadowed module, in accordance with an embodiment of the present invention;

FIG. 5 illustrates an exemplary architecture of a dual processor showing the relationship between the RF (radio) processor and the event processor, in accordance with an embodiment of the present invention.

Figure 1:
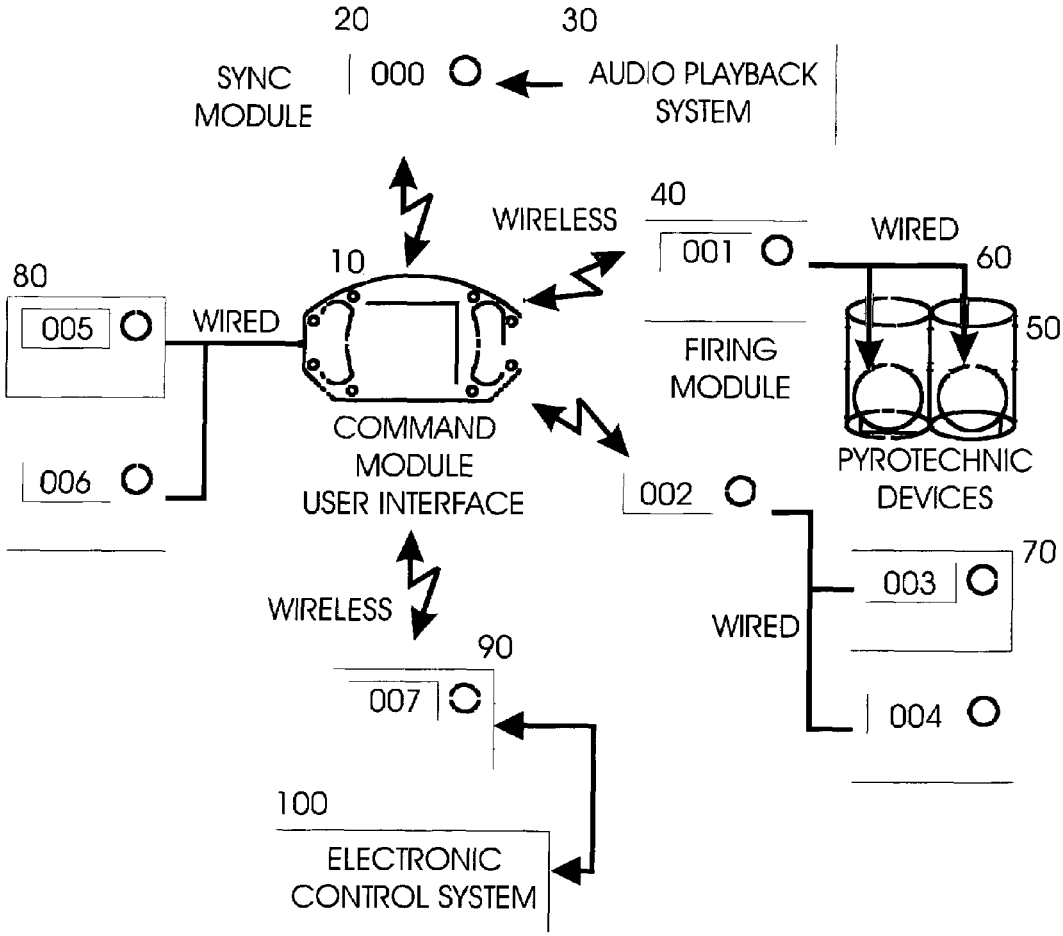
FIG. 1 illustrates the architecture of an exemplary distributed pyrotechnic firing system, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a variety of techniques for zero latency distributed processing of timed pyrotechnic events are described.

In one embodiment of the present invention, a method is provided that provides a distributed processor system whereby a list of timed events that synchronize a pyrotechnic firing sequence with music or other external events is distributed over a plurality of distributed processors. Each processor is then synchronized to a master controller clock, and enabled such that each processor may then fire independently as required by the master list. This distributed process greatly reduces, if not removes, the split-second timing requirement from the main controller enabling significantly more timing events to be processed simultaneously while alleviating problems such as, without limitation, wireless radio interference delays. This allows each event to be marked with zero latency from the synchronized clock. Each module is capable of acting as a command transmitter or receiver. In a command transmit mode of one embodiment of the present invention, any module may automatically forward data or timing information to another module with which it has contact. The timing and voltage, for example, of the output signal may be varied to properly interface to different types of devices and to optimize the amount of energy delivered to the effector.

In another embodiment of the present invention, a system for the distributed processing of timed pyrotechnic events is provided, which system includes a plurality of Firing Modules, where at least some of the plurality of Firing Modules being configured with computing units that act as a Master controller, and are further configured to output signals suitable for the firing of a pyrotechnic device; and, a Command Module that includes a master clock. The Command Module being configured with a user interface to the system and configured to transmit commands to at least some of the plurality of Firing Modules, and at least some of the plurality of Firing Modules being configured to synchronize with the master clock and to receive and execute the commands relative to the master clock.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

One aspect of the present invention is to provide a new method for distributed processing of timed pyrotechnic events that has many of the advantages of the pyrotechnic controls mentioned heretofore and many novel features that result in a new method for distributed processing of timed pyrotechnic events.

In the description below the term "zero latency" is used, and should be understood to mean that in various applications or embodiments of the present invention an exactly zero or near zero or relatively low (compared to the current art) latency are achievable depending on the particular implementation.

A method for zero latency distributed processing of timed pyrotechnic events, which comprises a Firing Module, a Command Module, and an optional Synchronization Module is presented. In one embodiment, a distributed processing approach is used instead of the master-slave architecture. Each pyrotechnic device may be wired to one of a number of independent master firing controllers. In principle, there are no slave devices. Other embodiments of the present invention may include slave devices depending upon the needs of the particular application. Similarly, in alternate embodiments of the present invention the master firing controllers may be substantially independent (e.g., have a small, but functionally negligible or very limited dependence on one another,); however, in yet other alternate embodiments it may be desirable to configure the master firing controllers so that each functionally depends on one or all the others in controlling the firing events. In this way, it is to be understood that any of the systems or devices taught herein to be independent may also be configured to be at least partially dependent on one or more other devices or systems to achieve a desired result depending upon the needs of the particular application. A Command Module serves as a user interface to allow the operator to interact with and issue commands to the community of independent controllers. In the present embodiment, once the individual controllers are given their list of events and are synchronized to a master clock maintained by the Command Module, each Firing Module becomes a part of a distributed processing system capable of executing all commands simultaneously and removing the bottleneck created by having only one master controller.

The architecture of the preferred embodiment also greatly reduces, if not, removes the problematic wireless connection from the critical path, so that no delays (zero latency) will be experienced due to interference or other wireless processing. In the present embodiment, the Firing Module is the equivalent of a Master controller, wired directly to the pyrotechnic devices.

FIG. 1 illustrates the architecture of an exemplary distributed pyrotechnic firing system, in accordance with an embodiment of the present invention. In the present embodiment, the distributed processing system is comprised of a Command Module 10 that acts as the hub for all communications between the independent elements and maintains the master clock. Command Module 10 initiates all communications, even though the other modules act independently. A Sync Module 20 is optionally connected to an audio playback system 30 or other mechanism that provides timing information to enable the system to be synchronized to music or other events, such as, but not limited to, a computer parallel, serial, infrared, or USB communications port, an audio signal, a SMPTE timing track, an FSK (Frequency Shift Key) timing signal, an external manual switch, a radio (RF) time signal such as an AM, FM, cellular telephone, shortwave, or GPS signal, an optical sensor, or a current or voltage pulse. Command Module 10 most often communicates wirelessly to a Wireless Firing Module 40 that contains the power and switching circuitry to fire pyrotechnic devices 60 at a programmed time. In the present embodiment, if Wireless Firing Module 70 is unable to communicate via the wireless link with Command Module 10, one or more alternate Firing Modules 70 may be connected via a wired connection to an additional Firing Module 75 that does have an active wireless link. Additionally, Command Transmit permission may be passed to one Firing Module with instructions to retransmit the data, command, or timing information to another unit not reachable directly by Command Module 10. Because the Firing Modules have the ability to vary the timing and voltage of their switched outputs, they may also be attached to other electronic devices 100 including, but not limited to, relays, computer I/O or parallel ports, stepper motors, intelligent or simple effectors, actuators, lights, sound emitters, timers, data recorders, motor controllers, spark emitters, other controllers, etc. In the event that a wireless connection to the Firing Modules is not possible or not desired, Command Module 10 may also be directly wired to wired Firing Modules 80.

In the present embodiment, Command Module 10 maintains the master clock and allows communication with Firing Modules. Command Module 10 serves primarily as the master synchronization clock and as a user interface to allow the operator to communicate with the aggregate community of independent Firing Modules. Command Module 10 also receives the total list of timed events that represents the pyrotechnic show or event, and prior to the start of the show transmits either wirelessly or by wire the appropriate subset of the total list to each Firing Module. Command Module 10 may hold more than one list of events or displays in memory, selectable by the user. In the present embodiment, only the events to be processed by a particular controller are transmitted to that module. Other command functions such as, but not limited to, self-test, continuity testing of the electric matches, actuator or motor movement or positioning, voltage, current, and time settings, reading external voltage or resistance, abort, pause, enable/disable module or outputs, encryption key exchange, attention required by device, battery status, output on/off, heartbeat enable/disable, operator security code, capacitor voltage status, enable/disable sleep mode, manual/automatic firing, set module ID, receive/transmit to external device, external trigger enable/disable, get number of cues on device, get device capabilities, set device mode, fire manual cue, set timing step, etc. may be performed either independently or upon user command, and results may be reported to Command Module 10 for display to the operator.

In the present embodiment, the Firing Modules are the equivalent of individual Master controllers, wired directly to pyrotechnic devices 50. The electric matches that ignite pyrotechnic devices 50 or other effectors such as, but not limited to, computer controls, blasting detonators, squibs, electric matches, lights, actuators, stepper motors, motor controllers, intelligent effectors, counters, plasma generators for detonator cord, sound generators, or relays, are wired to independent intelligent Firing Modules. In the present embodiment, each Firing Module has a set number of cues it can fire via its internal processes, but when used as a Master firing module additional slave devices may be attached via wired connection to increase the total number of effectors controlled by the Firing Module. Not all cues must be connected. Each connected cue may fire one or more electric matches wired in series or parallel, up to a limit calculated by the voltage and current specification of the Firing Module and the aggregate resistance of the electric matches.

In the present embodiment, each module contains all of the electrical power and programming to act as a complete master firing controller, plus wireless and/or hard-wired communications interfaces to link with Command Module 10 for instructions and cue/event information. The Firing Modules may also be connected to other Firing Modules to act as a wireless bridge to Command Module 10. The Firing Module includes all necessary command event processing logic, power, switching logic, and communications systems. Other modules may include, but are not limited, to high voltage output modules, computer interface modules, timing interface modules, motor control modules, actuator modules, stepper motor positioning modules, light, sound, or pressure sensor modules, high speed detonator modules, camera control modules, high current modules, spark emitter modules, sound or lighting control modules, external relay modules, intelligent effector modules, embedded computer modules, ultra-lightweight modules for aeronautics applications, rehearsal modules, simulation modules, communications modules to transmit or receive data on other frequencies or protocols such as LAN, WAN, Wi-Fi, Ethernet, Pager, Cell Phone, GPS, or other RF frequencies, opto-interruptor modules, laser projector modules, audio control modules, video or multimedia control modules, etc. In the present embodiment, the processing logic may be a single CPU, multiple processors, or a hard-wired logic control system that performs the same functionality. Power may be supplied by internal batteries, external power connections, or both. The power provided for electric match ignition or external device control may be converted to a higher voltage from a lower voltage such as the battery via a boost regulator, or reduced via a voltage regulator from a higher voltage, or both. In some cases battery power might be sufficient, and in other cases a capacitive-discharge (CD) circuit may need to be used to provide adequate power to the ignition devices or effectors. In the present embodiment, wireless communications may be at any allowed frequency or utilizing any standard or non-standard communications protocol. Wired communication may similarly be via any transmission protocol including, but not limited to, RS232, RS485, HDLC, SDLC, HTTP, TCP/IP, Zigbee, 802 standards, USB, Ethernet, LAN, WAN, FSK, closed caption, Bluetooth, cellular network protocol, and be serial or parallel in nature. The units may have conventional display means to indicate current status to the user such as, but not limited to, LCD displays, Light Emitting Diodes (LEDs), or no indicators at all in some alternate embodiments. Physical packaging of the units could range from an integrated case with connectors for wiring the electric matches to the module to a stand-alone module in a hardened protective case or epoxy encapsulated covering with a connector to an external wiring harness to connect the electric matches or other devices.

In the present embodiment, since each Firing Module functions as a complete master firing controller, it is impractical for the user to try to communicate directly with each individual module. Therefore, Command Module 10 serves primarily as master clock and user interface to allow the operator to communicate with the array of Firing Modules or to any applicable subset. To that end, Command Module 10 must have or be connected to some display and user input device to facilitate communication with the user, and contain the processing power necessary to maintain the master clock and the communications load of dealing with potentially hundreds or thousands of Firing Modules. In the present embodiment, the user interface may include, but is not limited to, an LCD display and touch screen, separate visual display and keyboard, plasma display, video device, printer, plotter, serial or parallel terminal device, proximity switches, membrane switches, joystick, game controller, Bluetooth or other wireless device, infra-red printer or display, or a display and mouse or other pointing device. In some embodiments, Command Module 10 may be connected to another external device that contains the user interface, such as, but not limited to, a laptop, tablet computer, or palm-based computer, either via wired connection or wireless link such as, but not limited to, WLAN, Bluetooth, cell phone, radio, optical, laser, or IrDA. In the present embodiment, to maintain the clock and provide fast communications, it is possible a multiprocessor configuration would be used, but a single processor or hard-wired logic performing the equivalent function may also be used. Additional processors may also be included as fail-over backup devices, so that any single failure of the main processor or communications processor would not cause the show to be cancelled or delayed. Because wireless communications is not always available or desirable, all inputs and outputs in the present embodiment of Command Module 10 are also duplicated via wired connections.

In the present embodiment, Sync Module 20 attaches to external synchronization signals and interfaces these to Command Module 10. Sync Module 20 acts as a wireless interface between Command Module 10 and any external signals that communicate synchronization information. For example, pyrotechnics are often synchronized to music. To accomplish this, the music is studied, and exact times for shell launch and burst are calculated relative to musical cues. In order to fire the shells at the appropriate time to the music both must be synchronized. In many cases, a timecode signal is embedded in or on an additional track to the music, so that the timecode information is an accurate depiction of time relative to the music. In the present embodiment, this timecode information is fed into Sync Module 20, and converted to an accurate internal timing clock, which can be interrogated by Command Module 10. Sync Module 20 uses the same radio technology and communication protocol as the Firing Modules, and requires sufficient processing power to maintain an internal clock and deal with a number of different synchronization protocols. The input time code might be one or more of a number of standard SMPTE protocols, for example, without limitation, a custom protocol developed specifically for this system, an FSK time code, or a timecode from another system for compatibility. In some embodiments, Sync Module 20 may be housed as a small separate unit, a personal computer plug-in module such as, but not limited to, PCI, PCI express, or ISA card or PCMCIA card. Power could be supplied by internal battery or external source such as, without limitation, USB connection or power supply. If Sync module 20 is housed as part of another device such as a PC, laptop or palm computer, the external device could perform some of the tasks of interface and clock maintenance and leave only communications to Sync module 20.

In the present embodiment, Command Module 10 is the communications hub for the distributed processing system. It initiates all communications to the Firing Modules and Sync Module 20, except when Command Transmit permission is passed to one of the Firing Modules for bridging to another unit. Communication may be via wired or wireless connection, or a combination. For example, some Firing Modules may communicate via wireless link, while others are connected to either Command Module 10 or to another Firing Module via wired connection. In the present embodiment, Sync Module 20 may only connect to Command Module 10, but one Firing Module may act as a bridge, transferring communications from Command Module 10 to one or more Firing Modules connected to the bridge Firing Module via wired or wireless connection. The distributed processing model may be taken to two extremes for illustrative purpose, but can operate in any combination of modes between the two extremes. First, one Firing Module might provide all of the power, processing, and signal switching to fire all of the events in a show. On the other end of the spectrum, one Firing Module might only be connected to one effector, simplifying wiring of the display. Between these two extremes, one module might contain any arbitrary number of outputs between one and the maximum number of cues required for operation. The total number of cues in the system may exceed the total number required. For example, the user may only require 100 cues, but if each module has 32 cues, the minimum implementation that covers the requirement might be 128 cues. The user may also implement with additional modules to simplify or improve communications, simplify or minimize wiring, implement additional functionality, or read external sensors. Other synchronization models are possible such as, but not limited to, direct reception of AM or FM radiobroadcasts, GPS or shortwave reception, external sensors such as light, sound, or pressure, cell phone reception or connection with a cellular device, Wi-Fi, LAN, WAN, Ethernet, fiber optic communications, external switches or current/voltage triggers, serial or parallel ports, SMPTE or FSK information, audio, video, closed caption information, telephony signals, pagers, or synchronization to the standard atomic clock via shortwave broadcast. In some alternate embodiments, sufficient synchronization might be accomplished simply by manually pressing the fire button on Command Module 10.

During operation of the present embodiment, all modules first perform a series of self-tests and safety checks when power is first applied or they are awakened from sleep mode by a button press. Firing Modules, for example, must verify that the capacitors storing charge for the ignition of electric matches are fully discharged and the switching circuits disabled and rendered safe. It would then display a message such as, without limitation, "001 SAFE" or other indicator to inform the operator that it is safe to connect firing circuits to the device. If the capacitors are not fully discharged, the operator must be warned not to connect until discharge has completed. Once safe, the Firing Module next waits for a contact signal from Command Module 10. In the present embodiment, Command Module 10 periodically attempts communication with all modules as identified by the master event or cue list programmed by the user. Command Module 10 sends an inquiry to each device in turn, and waits for a response. If there is no response, it goes on to the next module number and continues trying. If the Firing Module has been activated and receives the inquiry from Command Module 10, it responds with its current status. This response logs the Firing Module as connected with Command Module 10, and Command Module 10 will proceed by downloading that particular module's cue list. In the present embodiment, each Firing Module is uniquely identified. This identification may be a permanent internal value, set by the user as the unit is activated, or assigned via Command Module 10. The identification could also be pre-programmed into the device along with the firing command list. For example, in some embodiments, when the first unit is turned on, it may not already have an ID assigned to it. In this case, a default ID such as, without limitation, 000 or 1000 would be initialized, and Command Module 10 would be trying to establish contact with this default value. In the present embodiment, upon establishing communications, Command Module 10 would notify the user that the next available ID is 001, and ask for confirmation or a change. If the user does not respond (he might be the one in the field turning on the units) this next available field is used after a timeout delay. If the user does change the value, he can therefore set the modules up in any order via the user interface. In the present embodiment, there may be two levels of identification that allow two modules to act on the same firing event list, but still be uniquely identified. For example, an identification scheme might consist of a three-digit number to identify the set of events to be loaded into the Firing Module, plus another identifier to differentiate between two modules, which might be required to execute the same list, such as, without limitation, 001-A and 001-B. This allows two or more Firing Modules to execute the same effector and event list if desired. This identification scheme may be required if a large number of effectors must be controlled by the same events, or if some effectors are widely separated by distance or obstructions.

In the present embodiment, the Firing Module must check all methods of communication to determine if it can communicate with Command Module 10 via wireless or wired means, and if wireless, are other modules connected to this one via the wired connection making it a bridge device. This is done by listening for the inquiry from the command via the wireless link, at the same time enabling the wired link and waiting for an interrupt to indicate activity. If the wireless link is enabled as the communications link to Command Module 10, Wireless Firing Module 40 then begins to periodically transmit an inquiry command on its wired connection port to determine if any modules are connected via that link. This inquiry cycle terminates when the system is armed for operation or if Command Module 10 issues a command for all Firing Modules to enter standby or sleep mode. In the present embodiment, Command Module 10 may issue an instruction to a Firing Module to assume Command Transmit permission and transfer information to another Firing Module or to create a Field Map. In the present embodiment, the Field Map is a list of all other Firing Module with which this module can effect communications. In the present embodiment, the Firing Modules, once placed, are not mobile as they are wired to the effectors, and the Field Map, therefore, remains effective throughout the firing process. When given Command Transmit permission, Command Module 10 enters a listen-only mode and transmit permission is transferred to the Firing Module. It can then attempt to communicate with all other modules and log in the Field Map list which modules it was able to reach. When the Field Map for the module is complete, it is transferred to Command Module 10 and then Command Transmit permission is returned to Command Module 10 as well.

It is not unusual for the Firing Modules and wiring to be completed hours before a show. To conserve battery power in the present embodiment, the modules may be directed to enter standby or sleep mode. In standby mode, the unit goes into power-down mode for two minutes at a time, where only the internal timer and memory is active. At the end of this period, the unit powers up the radio and listens for a predetermined time, usually only a few seconds, for an activation signal. If it is not received, the unit powers down for another two-minute period. If the activation signal is received, the unit resumes full power operation. Any time period can be used for the standby mode.

When the user issues the command to go to full power again, Command Module 10 broadcasts a continuous stream of activation messages for a time period larger than the sleep mode setting of the Firing Module, in the present embodiment, approximately three minutes, but other time settings may also be suitable. This guarantees that all sleeping modules would have heard the activation message at some point. Other modules may be given Transmit Permission and instructed to issue wake-up commands as well, to reach any shadowed units. The modules ignore all further activation messages after the first reception. Command Module 10 then sends inquiry messages to all modules to verify that they are again operational and repeats the process if necessary. If a module does not resume activation after two attempts, the user is warned of a possible problem. In sleep mode the unit turns off completely, enters maximum power savings mode, and awaits a key press to begin operations. It then begins operation from the initial start point again. This allows the units to be connected to their firing circuits, all systems checked, communication and circuit continuity verified, and then the entire system shut down for any period of time before it begins operation again.

In the present embodiment, once all modules have performed successful self-tests and received and validated their cue lists, the community of independent controllers is synchronized to a single master clock maintained by Command Module 10. Synchronization is necessary to allow the community of independent processors to act as one distributed processing entity. Once the clocks are synchronized, Command Module 10 may at any time issue the firing command to the Firing Modules. At that point each module independently switches firing current to its electrical matches at the designated time but the overall system acts in concert to execute the entire show list independent of further commands from Command Module 10.

Other factors such as, without limitation, the voltage to be presented at the output, and the length of the firing pulse may now also be variables optimized for the performance of the event. For example, in a capacitive firing system low battery voltages of perhaps six volts are increased via a charge pump circuit to perhaps 30 volts, and the charge is stored in large capacitors. Each firing event reduces the voltage stored in the capacitor bank. In the present embodiment, the capacitor bank is designed such that all cue events firing simultaneously would have sufficient energy to meet worst-case demands for a minimum firing period; e.g., in some applications 12.5 milliseconds may be typical. If the system knows from the cue list, however, that the cues are not being fired simultaneously, it is possible to calculate how much additional charge may be delivered to the capacitor bank in the period between cues. As a result of this calculation, the firing period can be increased as needed (typically, for example, to 50 milliseconds or more)

per firing cue, thereby greatly increasing the reliability of the firing system, particularly when the electric matches are wired in parallel and often reach the maximum current limit of the firing circuit. When wired in parallel, longer firing pulse widths significantly increase the power delivered to the electric matches for ignition.

Figure 2:
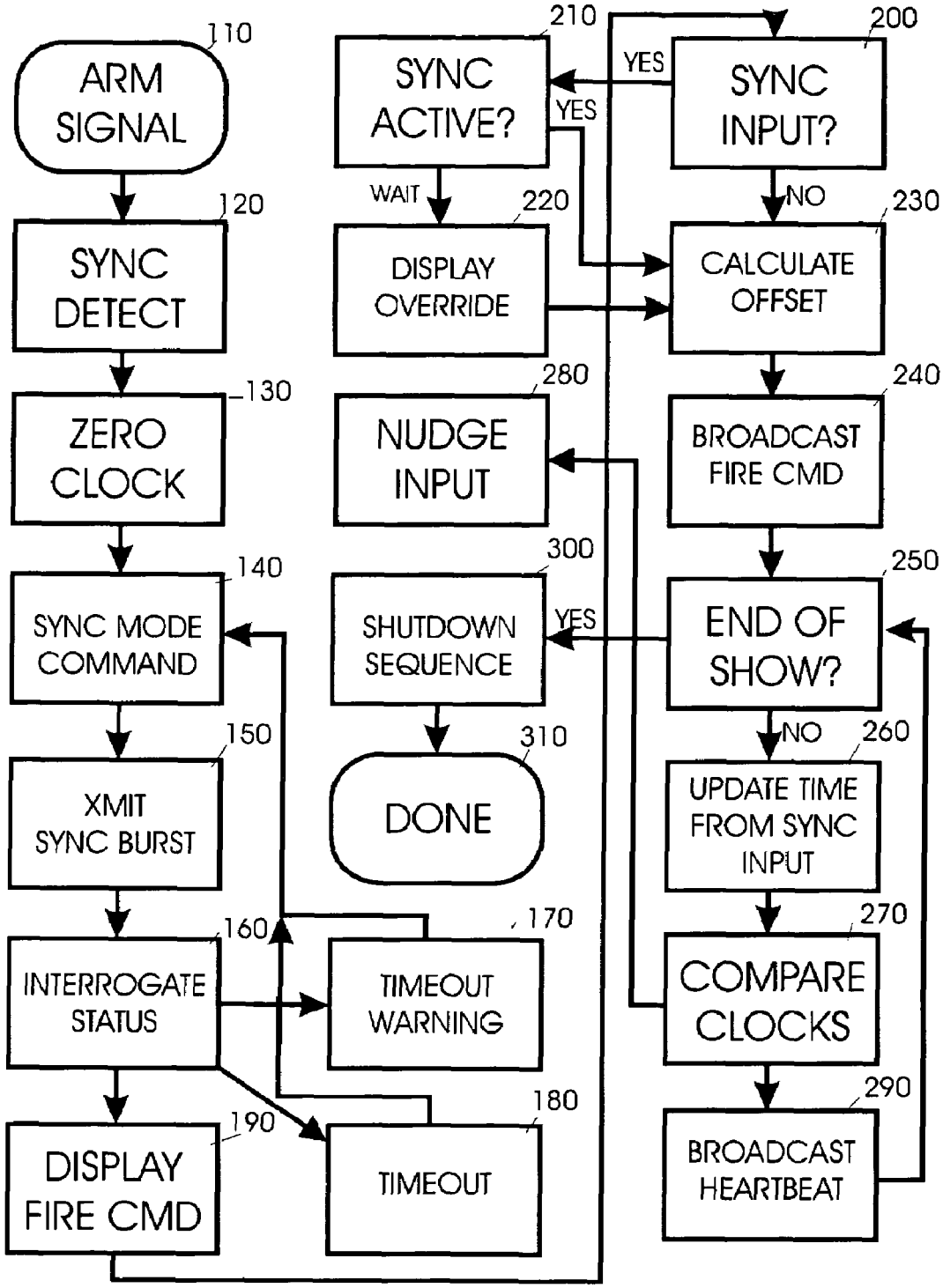
FIG. 2 illustrates an exemplary clock synchronization flow chart detailing the methodology for synchronizing multiple independent devices, in accordance with an embodiment of the present invention.

FIG. 2 illustrates an exemplary clock synchronization flow chart detailing the methodology for synchronizing multiple independent devices, in accordance with an embodiment of the present invention. At startup, each Firing Module has its own independent clock that could have any random value. The purpose of the first synchronization step is to set the clock value of all units to the same value. To do this, it is necessary to minimize the variability of communications delays between modules. In the present embodiment the synchronization process begins with Step 110 when the user gives the command to Arm the system. This may be done hours before the system is to be fired, but is usually done approximately thirty minutes before firing so that there is enough time for the operator to fix any additional problems that might occur at this stage of the process. It may also be done immediately before firing. After the system is armed, the Command Module continues on to Step 120. At Step 120, the Command Module tests for the existence of a Sync Module. If communication with the Sync Module is established, it sets a flag, and the internal clock is zeroed at Step 130 because the internal clock may have been any value before Step 130. Then in Step 140 the Command Module begins broadcasting a message to all Firing Modules or to all unsynchronized modules to enter a defined synchronization state. This assures that all other asynchronous processes within the module are suspended for the duration of the synchronization event, the radio is in receive mode, and the least number of processing cycles are being expended. Synchronization is then accomplished in Step 150 by sending a series of broadcast messages to all modules simultaneously. In each broadcast message, the value of the current master clock is broadcast, followed by a short delay, so that the value of the master clock is guaranteed to have changed between broadcast messages. In the present embodiment, at least eight synchronization messages are broadcast. As the Firing Module receives the first broadcast packet, it immediately sets the value of its internal clock to the same value, plus a pre-calculated offset value to account for all determinate delays in processing and transmission. Because this synchronization state is well defined, the offset time is constant. As subsequent broadcast packets are received, the value of that clock, plus the delay offset, is compared against the current value of the internal clock. In the present embodiment, if five values are received that show exact correlation between the master clock and the internal clock, the system is considered synchronized. If three values are received that correlate, but do not correlate with the first clock value received, the three correlated values are used to set the internal clock value again, and we again look for a total of five correlated values. This allows for the Firing Modules to miss some of the transmitted packets and still correlate enough values to determine a good synchronization. After eight packets are received or a timeout period equivalent to eight packets has expired, the system exits synchronization mode and returns to processing normal commands from the Command Module.

At the end of Step 150, the synchronization broadcast, the Command Module proceeds to Step 160. At Step 160 of the present embodiment, the Command Module sends a status request to each Firing Module. The Firing Module will report whether it had achieved synchronization or not. If any modules have not been able to synchronize clocks, they are given the command to return to Step 140 to enter synchronization mode again and the process is repeated, but only for those modules not already synchronized. In the present embodiment, if multiple attempts to synchronize are unsuccessful, the user is notified in Step 170 that the module may not have adequate communications bandwidth for operation and should be wired directly to the Command Module or to another Firing Module. Once the first synchronization is complete, all clocks on all modules are running at the same rate. Some clock drift due to slight differences in voltage, component values, and crystal tolerances is to be expected, so it may be necessary for the system to periodically go into timeout, as indicated by Step 180, and repeat the synchronization process starting at Step 140. If some Firing Modules are directly wired to other Firing Modules (bridge units), the bridge unit would then repeat the synchronization process with all modules wired to it, just as if it were the Command Module. If a given Firing Module is unreachable by the Command Module but can be reached as determined by the Field Map, the Command Module will transfer Command Transmit permission to another Firing Module with instructions to synchronize the unreachable unit. In some embodiments, when complete independence is not desired, this capability may enable the behavior of one module to, at least partially, functionally depend on another module in the system.

The second stage of synchronization is to identify the starting time of the firing sequence. While all clocks in the command and Firing Modules share the same value, it is in itself a random value that does not correspond to any fixed time reference. The timing of the firing cues in the present embodiment, however, are all referenced to an initial fixed time relative to the music, T=0. This second stage begins at Step 190 when the user presses the Fire button. For manual firing, the fire command is broadcast immediately. For controlled firing of the present embodiment, the user pressing the Fire button can be interpreted in two ways, depending on user preferences set in the original cue list. In the first case, pressing the Fire button does not require any external synchronization, and indicates a set delay (user definable) from the keypress to T=0. This is also used in blasting applications when all of the events are synchronized to T=0 but not to another external event or signal. In the second case, synchronization with an external timecode is required, and when the Fire key is pressed the system begins evaluating the incoming timecode. In the present embodiment, the Command Module begins evaluating the incoming timecode at Step 200 by querying the Sync Module for status and its internal clock or directly interpreting the timing signal coming into the Command Module. The timecode may start at some negative value, with cues referenced to T=0, or it may start at some arbitrary positive time, with cues referenced at that time plus some offset. If no timecode is yet available, the Command Module proceeds to Step 210 and continues to query for the start of timecode and continues to Step 220 by displaying an override option that would allow the user to actuate the firing sequence manually, if a problem has just developed with the sync system. Once the sync signal is detected, at Step 210, or the firing button has established the starting time for a non-synchronized system, the Command Module proceeds to Step 230 and uses this time information to calculate the value of the existing synchronized master clock that will correspond to T=0 in Step 230.

In the present embodiment, once the Command Module had calculated the offset, it proceeds to Step 240. At Step 240, once the user has authorized the system to fire, and as soon thereafter as T=0 has been established, the Command Module transmits multiple broadcast messages to all Firing Modules simultaneously. In the present embodiment, the content of this broadcast message is the time on the synchronized clock that corresponds to T=0. Because the clocks are already synchronized, the timing of the command, potential missed packets, and other aggregate delays are inconsequential to the process. Upon receipt, the Firing Module adds the value that corresponds to T=0 to all of the internal stored cue event times that are stored for this module. This produces firing event times that correspond to the synchronized internal clock, and when the clock reaches the combined time value the Firing Module can perform the event specified. Because the event is processed by the firing controller's processor, it can be defined either by a bit map specifying which cues are to be fired, or by an operations code that specifies any other activity to be performed. For example the event command may cause a number of pulses to be output from the event controls to move a stepper motor or activate another device.

In the present embodiment, the Command Module transmits the broadcast message at Step 250 during the time interval of active firing of the show, and the Command Module proceeds to Step 260 to continue to query the Sync Module. The time of the Sync clock is then compared to the time of the Firing clock at Step 270. If the time reported by the Sync Module deviates plus or minus from the firing clock maintained by the Command Module, the Command Module continues on to Step 280 where the timing interval of the master clock can be shortened or lengthened slightly to chase or try to catch up with the sync clock, or "nudged", as shown in Step 280. In an alternate embodiment, it is also possible for the operator to request that timing be "nudged" positively or negatively by a small amount to compensate for inaccuracies in the delay times in the shells. In the present embodiment, the sync clock and all other clock adjustments are compared to the master clock, and if necessary the master clock is adjusted as well. At Step 290 the final clock value is broadcast to all Firing Modules as the heartbeat signal. The heartbeat is transmitted about every ½ second, and the Firing Modules will cease operation if they see a sustained failure to receive the heartbeat within two seconds. Intermittent failures to receive the heartbeat are to be expected and will not cause shutdown.

In the present embodiment, if the Firing Modules detect a discrepancy between their internal synchronized clocks and the heartbeat clock, they too will compensate their timing intervals to match the master clock. In addition to these maintenance commands, as the operator no longer has to activate every cue manually, he can now exercise control over the show itself, rather than over every individual cue. In most cases, the pyrotechnician is attempting to synchronize the burst of the shell to some point in the music or another event. In practice, the Firing Module controls the launch of the shell, not it's burst time. While the time delay from launch to burst is relatively constant, it can vary from by shell type and between manufacturing lots. Using the present embodiment, if the operator sees that the shells are bursting slightly earlier or later than was programmed into the timing of the show, he can instruct the Command Module to "nudge" the master clock slightly faster or slower to compensate. Changes to the master clock are communicated, in turn, to the firing controllers.

After the heartbeat has been broadcast at Step 290, the Command Module returns to Step 250 to determine if the show has ended. If the show has not ended, the Command Module repeats Steps 260 through 290 and continues doing so until the end of the show. When the show has ended, the Command Module proceeds from Step 250 to Step 300 to begin the shutdown sequence. At the end of the show, represented by Step 250, all Firing Modules automatically begin discharging their capacitors and applying safety interlocks to prevent inadvertent firing signals. It is possible that unexploded pyrotechnic devices are present at the end of the show. In the present embodiment, the Command Module begins querying all of the Firing Modules at Step 300 to determine if they have completed the shutdown and discharge sequence. When all have reported safe, the Command Module informs the operator that all Firing Modules are safe and discharged, and he may now enter the area. The firing sequence is now complete and the system returns to its reset state to be shut down or execute new operator commands at Step 310. In another embodiment the user may issue a command to prevent the module from discharging the firing circuits until an "fire all" command has been issued. For example, there may have been some unexploded ordinance or shells that were skipped in the sequence and are still in their mortar tubes. The fire all command would cause all cues of the module to be fired to clear any unexpended shells.

In the present embodiment, after the firing command is given at Step 240, the Command Module is primarily used to provide abort and override commands to the user, as no further interaction is required for the show to commence and the cues to be fired. The user may also use the Command Module to fire a given cue manually, to disable cues or groups of cues, or entire Firing Modules. In order to maintain control of the entire process some control information continues to be transmitted from the Command Module to the Firing Modules. It is significant that this information is not timed firing commands, as are necessary in a master-slave architecture, but commands which allow the operator to exercise a level of control over the entire process of the execution of the show hitherto impossible to achieve. For example, industry regulations require that automated firing systems be equipped with what is referred to as a "deadman" or Operator Presence Device (OPD) switch so that if the operator loses consciousness, firing activities will automatically cease. A command must therefore be available in the present embodiment so that if the OPD switch activates, the Command Module can send an immediate command to all units to cease firing. If the Command Module is communicating via a wireless connection with the Firing Modules, however, it is possible that the Command Module may be rendered inactive by being dropped, falling into water, or otherwise disabled. A "heartbeat" or watchdog signal must therefore be periodically sent from the Command Module to the Firing Modules to indicate that the link is active. Cessation of the link would indicate a problem or lack of positive control, and firing would cease.

Another command exists for the present embodiment that allows the operator to disable portions of the show depending on environmental or other considerations that may have changed at show time. If high wind conditions exist, for example, the operator may decide to disable all shells that burst over a given altitude. The user may instruct the Command Module to activate pre-programmed disables or to disable individual firing cues, or to disable and entire module. These commands are similarly passed down to the effected Firing Modules.

The present embodiment of the invention also includes a "find" command. In a dark field in the middle of the night, it might be difficult to locate a wireless device. The find command tells the unit to begin blinking its indicator lights to make it easier to locate. In extreme cases, because the unit is wireless, it can be instructed to send radio bursts which can be used for directional location with the appropriate antenna.

Because the amount of time required to complete the Arm and Fire synchronization steps is dependent on the number of modules and their physical configuration (how much auto-forwarding is required), it may be advisable to perform a "rehearsal" of the firing steps prior to the show to make sure there is sufficient time and that there are no error conditions. In this mode, the Command Module first issues a rehearsal command to all firing modules and actively reads their status to make sure they are in rehearsal mode. It then goes through the Arm and Fire command steps, and logs the amount of time that is required to complete each step. To avoid any potential confusion, the actual coding of the commands transmitted are not identical to the active Arm and Fire commands. These times are reported to the user along with any error or warning indications, then the Firing Modules are restored to Active Mode and again status is checked to make sure each module is in the correct state.

Other exemplary commands which may be issued from the Command Module to the Firing Modules include, but are not limited to: Actuator or motor movement: this command allows On/Off, Pulse Count, Relative or Absolute positioning of an actuator, motor controller, or stepper motor. Voltage Setting this command sets the output voltage on a module or an effector output. Current Setting: this commands sets the maximum current limit on a module or effector output. Time Settings: this command sets the default pulse width on a module or an effector output, or otherwise specifies a particular pulse width to be used in a given situation or with a specific effector. Read External: this command allows the module to read and report voltage, resistance, current, temperature, pressure, or other values of internal or external sensors within or attached to the module. Abort: this command halts all firing or processing of commands and causes all modules to perform whatever actions necessary to safe themselves and discharge effector power supplies. Pause: This command causes all effector command functions to halt, but leaves internal clocks running and effector power supplies charged in the anticipation of resuming command execution. Enable/disable Module or Outputs: this command allows the Command Module to issue an Enable or Disable, which can effect either the entire module or any subset of the effector outputs. Encryption Key Exchange: this command allows the Command Module and Firing Module to exchange a set of encryption keys, such that all further communications either require this key or are encrypted with this key, such that another system cannot issue commands to this Firing Module once the keys are exchanged. This is done during the establishment of the connection between the Command and Firing Modules, and will remain in effect until the Firing Module is powered down, reset, or explictinly commanded to reset its encryption keys by the Command Module. Attention Required By Device: this command queries the Firing Module to ascertain if data within the device is ready to be uploaded to the Command Module, or other conditions which may require operator intervention exist. Battery Status: this command allows the Command Module to interrogate the voltage reading of the unit's internal battery (if available). Output On/Off: this command allows the user, via the Command Module, to manually control the state of the effector output in real time. Heartbeat Enable/Disable: this command allows the operator to enable or disable the Firing Module's reliance on the Command Module's heartbeat signal as an indicator of positive control. If disabled, the Firing Module will not cease operations if the heartbeat signal is lost. Operator Security Code: this command allows each Firing Module to independently ascertain that it's operation is enabled by the operator's knowledge of a security code, PIN number, or password. Capacitor Voltage Status: this command allows the Command Module to interrogate the Firing Module's effector power status or voltage reading. Enable/Disable Sleep Mode: this command instructs the Firing Module to enter a sleep or low power management mode. In this mode, the module periodically listens to the RF or wired signal for a Disable Sleep Mode command. Manual/Automatic Firing: this command allows the Command Module to set the mode of the Firing Module, independent of any other settings it may have received. Set Module ID: this command sets the unique identifier of the module. Receive/Transmit to External Device: this command would be used to transfer data to/from the Command Module, through the firing module, to some external device connected either via wire or wireless signal. External Trigger Enable/Disable: this command allows the Command Module to enable or disable the use of external triggers in a module. Get Number of Cues on Device: this command allows the Command Module to interrogate the Firing Module for the total number of cues and/or effectors it is able to control. This can change based on equipment failures, additional slave modules wired to the device, or external devices. Get Device Capabilities: this command allows the Command Module to query an unknown Firing Module type for a list of effectors, voltages, currents, and other information to properly address and utilize the module. Set Device Mode: this command allows the Command Module to specify a particular mode of operation, manual, automatic, transmit permission, sleep, or other command not listed above, etc. Fire manual Cue: this command allows the user to activate a given effector manually in real time. Set Timing Step: this command allows all effector outputs of a given module to fire with a timing separation given by the command.

FIG. 3 is a flowchart illustrating an exemplary method of how the Command Module is enabled to perform the Field Mapping function, in accordance with an embodiment of the present invention. Shadowing occurs when the radio signal from the transmitter to the receiver is blocked by structure or distance. During the initialization stage, Step 320, the Command Module attempts to establish communication with all modules described in the event list. It will continue to attempt communications until all Firing Modules are located at Step 330. If all of the Firing Modules are located, the Command Module will continue on to Step 360. If not all of the Firing Modules have been located; the Command Module will proceed to Step 340 to check if a timeout interval has expired. If a timeout interval has expired, the Command Module will continue on to Step 360. If no timeout intervals have expired, the Command Module will proceed to Step 350 to check for a user prompted halt. If, at Step 350, the user has actively terminated this procedure, the Command Module will continue on to Step 360. If at the end of the procedure not all modules have had communications established, the Command Module will proceed to Step 370. At Step 360, the user may also request the Command Module to proceed. At Step 370 the Command Module begins to perform Field Mapping to establish the communications map necessary to reach modules that are shadowed or may become shadowed by a change of location by the Command Module. If all modules have been located and the user does not intend to move the Command Module, this step may be skipped.

In order to build the Field Map in the present embodiment, the Command Module begins at Step 380 by issuing commands to each Firing Module in turn to assume Command Transmit permission and, in Step 390, construct it's own intermediate Field Map as described above. Then, at Step 400, the Command Module checks to see if the process is complete. If the process is not complete the Command Module returns to Step 380 and attempts to complete the process. When this process is complete, the Command Module proceeds to Step 410 where Command Transmit permission and the intermediate Field Map are transferred back to the Command Module. When all Firing Modules reachable by the Command Module have transmitted their maps, the result is a complete matrix of all connectivity between the static Firing Modules. In the present embodiment, the Command Module may then determine that the missing modules may be contacted through a bridging unit at Step 420, through auto-forwarding of commands, or that it is not reachable by any means. If the missing Module is not reachable, the user is notified of the communications failure at Step 430. If the missing Module is reachable, the process may continue on to Step 435. In the event that auto-forwarding is the only way to reach a module, the user is informed and advised to reposition the module if possible, but the system is still capable of operation. Even if all units are reachable at this point, the Field Map will allow the Command Module to find a communications route to any module that may become shadowed at a later time.

In the present embodiment, a data packet comprising the given instruction packet and a full description of the routing path is transmitted to the first Firing Module in the bridge route at Step 400 in order to transmit commands, data, or timing information to the shadowed module, and that module is given Command Transmit permission. If the destination module is part of it's intermediate Field Map created in Step 410, the command or data is then transmitted directly. If the destination is not reachable by this module, it establishes contact with the next module in the bridge route, and transfers the entire data packet and Command Transmit permission to the next module. This process continues until the final destination is reached. When the packet has been delivered to the destination, its response is transmitted back to the previous module, and Command Transmit permission is returned to the previous module. This continues until the response packet and Command Transmit permission are returned to the Command Module.

In addition to allowing communication with shadowed modules this methodology effectively increases the range of the Command Module to the Firing Module. If Firing Modules exist in an unbroken chain between the Command Module and the farthest Firing Module, the range of the system is extended potentially without effective limit as long as sufficient time is allocated for the communications steps described above to be performed.

FIG. 4 illustrates an exemplary Field Mapping Routing Path showing how the field map is utilized to determine the shortest routing path to a shadowed module, in accordance with an embodiment of the present invention. In the event of a shadowed Firing Module, the Command Module processes the field map to determine the shortest routing to the affected module. In the present embodiment, this process starts by determining which modules are reachable by the Command Module, and listing those modules in a reachable module list 440. The Command Module also determines which modules are reachable by the shadowed Module and lists those modules in a shadowed module list 450. If there is one or more overlap between these two vectors, a single bridging route 460 is found. If there are no overlaps, then the list is expanded by all modules that can be reached by these two module sets, and if at least one overlap exists a two bridge route 470 is detected. This process continues until a path is found for each module, regardless of the number of bridges required. Those skilled in the art will readily recognize, in light of the teachings of the present invention, a multiplicity of alternate and suitable methods and means to achieve the functionality of the Field Mapping aspect of the present invention.

FIG. 5 illustrates an exemplary architecture of a dual processor showing the relationship between RF (radio) processor 480 and an event processor 520, in accordance with an embodiment of the present invention. The implementation of the Command and Firing Modules may be done with either a single processor or multiple processors. Because of the real-time constraints of accurate event timing and Frequency Hopping Spread Spectrum (FHSS) radio protocols, the present embodiment would use two processors. In some embodiments, the processors may be of low cost. In the present embodiment a radio processor 480 would be used for both wired and wireless communications, and an event processor 520 would be for the generation of the zero-latency timed event outputs. Both processors require high speed real-time processing. Radio processor 480 connects to or may contain the radio subsystem 490. It also connects to or contains a wired interface, which may be a serial or parallel bus system and any number of wired connections 500 and a timing synchronization signal decoder 510. It is then connected to event processor 520. Event processor 520 is connected to appropriate user interface components 530, memory storage 540, and event controls 550. In the present embodiment timing and synchronization clock elements are maintained within event processor 520 to guarantee the lowest latency and greatest control over the synchronization process. In this dual processor configuration, radio processor 480 may request service from the event processor 520 when it has new data from the external connections that must be processed. Event processor 520 can request service from radio processor 480 when it has a message to send.

This generalized architecture of the present embodiment works for both the Firing Module and Command Module. In the Firing Module, user interface 530 may be as simple as a single button or a proximity switch. In one embodiment of the present invention, the firing module is completely encapsulated in epoxy resin, and a proximity switch is used to sense user input with no moving parts. In another embodiment, multiple proximity switches or a keypad could be used. In the Firing Module, only enough memory to hold software upgrades is required. In the Command Module, in one embodiment the user interface may be an LCD display with touch screen. In another, it could be a USB or RS-232 connection to a laptop computer or other user interface device. The memory of the Command Module should at least be large enough to hold the entire display, but could be large enough to hold a number of displays plus software upgrades to download into other modules.

In the present embodiment, the external connectivity of the Command Module is intended to simplify setup and operation of the system, as well as to provide the ability to expand the capabilities of existing systems. An aspect of the present embodiment of the Command Module is the ability to trigger the Fire command from an external input 560. This allows the system to be used as a subroutine to another system. For example, one effector current line from another system may be connected to an external trigger interface, such as, without limitation, external input 560. When sufficient current to fire the effector is sensed across the interface, it is the same effect as pressing the Fire button on user interface 530, and an entire sequence of automatic firing is initiated utilizing only one cue from the host system. In alternate embodiments, interfaces may include a plurality of connectors to simplify the synchronization input to the system. These may include, without limitation, XLR connectors, RCA connectors, RS-232 serial ports, or binding posts to provide audio or data inputs to be used for synchronization. Other exemplary synchronization or communications interfaces may include, but are not limited to, fiber optic connectors, transducer couplings, electrical sensors, current or voltage pulse sensors, SCSI connectors, wiring harnesses, external RF or audio input readers, A/D converters, DB-25 serial or parallel connectors, wire spring terminals, proximity sensors, detonator cord sensors, spark detectors, temperature sensors, flat or ribbon cable connectors, etc.

In view of the foregoing, it is clear that in at least one embodiment, the present invention generally comprises a Firing Module, and a Command Module in a distributed processing approach which is used instead of the conventional master-slave architecture. This improved architecture greatly reduces, if not removes, the problematic wireless connection from the critical path, so that no delays will be experienced due to interference or other wireless processing. Several aspects of the present invention will, without limitation, next be summarized and/or described in further detail.

An aspect of the present invention provides a method for distributed processing of timed pyrotechnic events whereby a list of timed events that synchronize a pyrotechnic firing sequence with music other external events, or to a predetermined time is distributed over a series of embedded microprocessors. Each microprocessor is then synchronized to a master controller clock, and enabled such that each processor may then fire independently as required by the master list.

Another aspect of the present invention provides a method for distributed processing of timed pyrotechnic events that implements a distributed array of fully functional master firing controller at the point where the pyrotechnic devices are directly wired to the firing circuit. This array is interfaced to and synchronized with a Command Module which performs all user interface functions such that the wireless link between the Command Module and the array of Firing Modules does not constitute a critical timing path.

Yet another aspect of the present invention provides a method for distributed processing of timed pyrotechnic events that can analyze the output signal firing parameter (e.g., without limitation, voltage, current, pulse width, and pulse timing) requirements of the device being controlled, and vary these parameters on a module-by-module and in some cases cue-by-cue basis to provide the optimum control of the device. In some embodiments of the present invention, this analysis to determine the proper these output signal parameters may be performed by any module in the system and be communicated to any other module in the system. For example, without limitation, in some applications one, some, or all firing modules may be equipped to directly detect, or receive communicated information regarding, environmental conditions that may effect the proper execution of a pyrotechnic event, and compensate the output signal parameters in known ways to achieve proper, or at least improved, execution of the pyrotechnic event. In some embodiments, each module in the system may communicate the raw environmental condition and/or output signal parameters compensation information to any other module in the system.

In another aspect of the present invention, a method is provided, for distributed processing of timed pyrotechnic events that uses distributed processing to greatly reduce, if not remove, the bottleneck presented by a master controller attempting to communicate with a number of slaves that must perform simultaneous operations.

Another object is to provide a method for distributed processing of timed pyrotechnic events that downloads all cues and firing/control information from the Command Module to the array of Firing Modules prior to the beginning of the control sequence, so that all controllers have full knowledge of the functions they are to perform prior to the firing command, knowledge of other modules in the system, and the electrical characteristics of the effectors to which they will be attached. This allows the Firing Module to perform more effective self-tests as well as continuity testing of the effectors, relieving the Command Module of significant computational and communications burdens.

Another object is to provide a method for distributed processing of timed pyrotechnic events that synchronizes the clocks of the array of Firing Modules to a master control clock maintained by the Command Module, so that the community of independent controllers can act in concert to produce an overall series of timed events. This clock may be synchronized only to the Command Module's internal clock, or to an external timing signal or event.

Yet another aspect of the present invention provides a method for distributed processing of timed pyrotechnic events that utilizes the Command Module as a user interface and synchronization system, such that Firing Modules may be communicated with via wired connection, wireless connection, or both simultaneously. Each Firing Module has similar capability, and can communicate directly with the Command Module, or can communicate with another Firing Module wired to it, or to another Firing Module with which it can maintain a radio connection. This allows a Firing Module to act as a wireless bridge between the Command Module and a Firing Module that may not have a direct communications link to the Command Module. This also allows the Firing Module to act as a Master controller to one or more slave devices attached via the wired connection while the Firing Module utilizes the wireless connection to communicate with the Command Module.

Another aspect of the present invention provides a mapping mechanism whereby each Firing Module, which is located in a static position in the field, creates a list of all other Firing Modules with which it can communicate either via wired or wireless link. Once all Firing Modules have completed mapping, their results are uploaded to the Command Module and an overall map is constructed that allows the Command Module to determine the optimal path to deliver data, commands, and timing information to any module independent of the movement or relocation of the Command Module or shadowing of any given Firing Module.

In yet another aspect of the present invention, a method is provided to allow one or more Firing Modules, acting as Master firing controllers, to interface directly to the user via a switch or trigger circuit obviating the need for the Command Module when firing manually. In this case, the user may simply attach a switch to the Firing Module, and when the switch is depressed the next effecter output in the series is activated. When the Firing Module reaches the maximum number of effecters it can operate, it continues to pass the firing trigger events to subsequent Firing Modules either via wired or wireless connections or both, until all events have been triggered. If a list of timed events has been loaded into the Firing Module's memory, this list may be used with the manual trigger, such that the manual trigger may act as the timing impetus to the event rather than the internal clock, in the event that the Command Module becomes disabled. Any of the Firing Modules may be used as the Master controller, connected to the manual switch.

Another aspect of the present invention allows external events such as, without limitation, the effecter output of another system to trigger the Command Module's firing sequence.

Yet another aspect of the present invention provides a specialized module, often referred to as a Synchronization Module, to perform the wired interface functions in the system, and transmit the timing information to the Command Module over the wireless link. This allows the Command Module to be portable and completely wireless, even when it requires an external synchronization signal to operate.

Another aspect of the present invention provides use of implicit synchronization information as well as explicit information to synchronize the external timing signal and the timed events. Explicit timing information might be in the form of SMPTE time code, for example, where the timing information is intended as the main clock of the system and may have an timing rate of 1/60 of a second or more. Implicit synchronization information is just as accurate, but much more granular, on the order of ½ second or less. In this embodiment, the Command Module maintains an accurate Master clock with a resolution of at least 1/100 of a second at all times, rather than relying on the external timing signal for timing information. The system need only periodically compare the Master clock to the external signal to determine if any drift has occurred. This greatly reduces the latency and computation overhead of the timing and comparison operations, and allows for simpler implicit external timing signals to be used. This also enables the show to continue firing from the internal clocks of all modules, even in the event of failure of the synchronization signal. In the event of loss, the system may either pause until it is restored, or continue firing at the user's discretion. The system would be unable to track any drift of the external events, but it would continue firing.

In another embodiment, a microcomputer of any type, including, but not limited, to a personal computer, laptop, palm, or smart phone may be used as the Command Module, with an RF or wired connection to the Firing Modules. This connection could be through a built-in system such as bluetooth or IrDA, or via an external circuit module attached to the PC such as WiFi, Ethernet, SCSI, 802.11 LAN, WAN, RS-232, RS-485, FSK, SMPTE, audio or video signal.

In another embodiment, not all of the timing information would need to be transferred to the Firing Modules before the start of the program. As long as the cue timing information for all affected modules is transferred before the time of the cue, zero latency can still be obtained.

In another embodiment, the identifiers and timing information for each module can be preloaded at any time prior to the show, and stored in non-volatile or other long-term memory such that the identification and download steps are already completed when the module is turned on. This allows for simplified setup, and the ability for the user to fire a more complex program in manual mode.

Those skilled in the art will readily recognize, in accordance with the teachings of the present invention, that any of the foregoing steps and/or system modules may be suitably replaced, reordered, removed and additional steps and/or system modules may be inserted depending upon the needs of the particular application, and that the systems of the present embodiment may be implemented using any of a wide variety of suitable processes and system modules, and is not limited to any particular computer hardware, software, firmware, microcode and the like.

Figure 6:
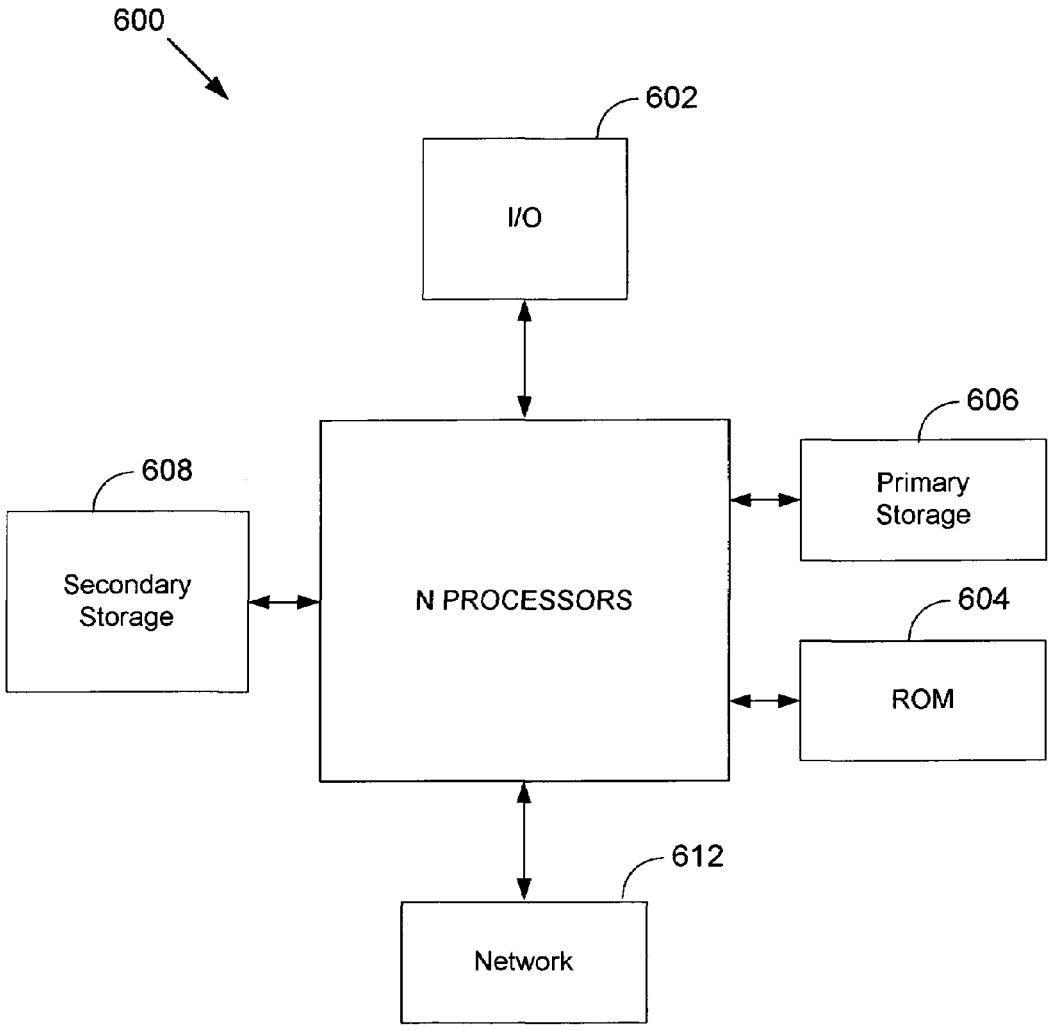
FIG. 6 illustrates a typical computer system that, when appropriately configured or designed, can serve as a computer system in which the invention may be embodied.

FIG. 6 illustrates a typical computer system that, when appropriately configured or designed, can serve as a computer system in which the invention may be embodied. The computer system 600 includes any number of processors 602 (also referred to as central processing units, or CPUs) that are coupled to storage devices including primary storage 606 (typically a random access memory, or RAM), primary storage 604 (typically a read only memory, or ROM). CPU 602 may be of various types including microcontrollers and microprocessors such as programmable devices (e.g., CPLDs and FPGAs) and unprogrammable devices such as gate array ASICs or general purpose microprocessors. As is well known in the art, primary storage 604 acts to transfer data and instructions uni-directionally to the CPU and primary storage 606 is used typically to transfer data and instructions in a bi-directional manner. Both of these primary storage devices may include any suitable computer-readable media such as those described above. A mass storage device 608 may also be coupled bi-directionally to CPU 602 and provides additional data storage capacity and may include any of the computer-readable media described above. Mass storage device 608 may be used to store programs, data and the like and is typically a secondary storage medium such as a hard disk. It will be appreciated that the information retained within the mass storage device 608, may, in appropriate cases, be incorporated in standard fashion as part of primary storage 606 as virtual memory. A specific mass storage device such as a CD-ROM 614 may also pass data uni-directionally to the CPU.

CPU 602 may also be coupled to an interface 610 that connects to one or more input/output devices such as such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPU 602 optionally may be coupled to an external device such as a database or a computer or telecommunications or internet network using an external connection as shown generally at 612. With such a connection, it is contemplated that the CPU might receive information from the network, or might output information to the network in the course of performing the method steps described herein.

Having fully described at least one embodiment of the present invention, other equivalent or alternative methods of achieving zero latency distributed processing of timed pyrotechnic events according to the present invention will be apparent to those skilled in the art. The invention has been described above by way of illustration, and the (specific embodiments disclosed are not intended to limit the invention to the particular forms disclosed. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. The invention is thus to cover all modifications, equivalents, and alternatives falling within the spirit and scope of the following claims.

What is claimed is:

1. A system for the distributed processing of timed pyrotechnic events, the system comprising:

a plurality of pyrotechnic devices;

a plurality of Firing Modules, at least some of said plurality of Firing Modules being configured with computing units that act as a Master controller, and said Firing Modules being further configured to output signals to said plurality of pyrotechnic devices suitable for the firing of a pyrotechnic device; and a Command Module comprising a master clock, said Command Module being configured with a user interface to said system and configured to transmit commands to at least some of said plurality of Firing Modules, and at least some of said plurality of Firing Modules being configured to synchronize with said master clock and to receive and execute said commands relative to said master clock.

2. The system of claim 1, wherein at least some of said plurality of Firing Modules operate substantially independent from one another.

3. The system of claim 1, further comprising means for communicating data or timing information from at least one Firing Module to at least one other of said plurality of Firing Modules.

4. The system of claim 1, wherein said output signals for the firing of a pyrotechnic device is synchronized to at least one external event.

5. The system of claim 1, further comprising means for varying at least one parameter of the output signal to deliver a required amount of energy to fire of the pyrotechnic device.

6. The system of claim 1, wherein the output signals for the firing of a pyrotechnic device are generated in response to an external trigger from the output of at least one other of said plurality of distributed processing units executing.

7. The system of claim 1, wherein at least some of said plurality of Firing Modules are configured to transmit or receive commands and therewith operate as a command repeater is said distributed processing system.

8. The system of claim 1, further comprising means for using two or more processing units to handle communications processing and real time event handling.

* * * * *